United States Patent [19]

Heaney

[11] 3,986,758

[45] Oct. 19, 1976

[54] NOVEL PRODUCT DISPLAY PANEL ADJUSTABLE SPRING-LOADED SHELF STANDARD

[75] Inventor: James J. Heaney, Glendale, Calif.

[73] Assignee: Anthony's Manufacturing Company, Inc., San Fernando, Calif.

[22] Filed: Jan. 31, 1975

[21] Appl. No.: 545,724

[52] U.S. Cl. ..... 312/236; 211/187; 312/117

[51] Int. Cl.[2] ..... A47B 87/02

[58] Field of Search ..... 248/345 R; 211/86, 148, 211/177, 236, 214; 312/114, 116, 117, 128, 257, 236; 108/109

[56] References Cited

UNITED STATES PATENTS

| | | | |
|---|---|---|---|
| 2,601,634 | 6/1952 | Rivette | 312/236 |
| 2,991,040 | 7/1961 | Levy | 211/86 |
| 3,677,202 | 7/1972 | Young | 108/109 |
| 3,693,556 | 9/1972 | Rous | 108/109 |
| 3,771,466 | 11/1973 | Ferdinand et al. | 108/109 |

*Primary Examiner*—Casmir A. Nunberg
*Attorney, Agent, or Firm*—Kleinberg, Morganstern, Scholnick & Mann

[57] ABSTRACT

An improved removable unitary product mounting structure for refrigerator cabinets; one adapted for easier, more convenient installation and removal and for more effective product display, comprising, in one embodiment, a pair of height-adjustable spring-loaded standards suspending a display backboard therebetween as an integral removable unit, the backboard being adapted for selective mounting of product carriers.

19 Claims, 10 Drawing Figures

NOVEL PRODUCT DISPLAY PANEL ADJUSTABLE SPRING-LOADED SHELF STANDARD

BACKGROUND OF THE INVENTION

1. Field of the Invention

This invention relates to refrigerated cabinet structures and, more particularly, to related product display structures adapted for mounting at various convenient selectable positions therein.

2. Background, Problems

Workers in the art of designing and constructing refrigerated cabinets for containing and displaying products for sale — e.g., as "point-of-sale" display — are familiar with the challenge of displaying products for maximum eye appeal (e.g., to stimulate impulse buying), yet doing so consistent with simple, versatile carrier means. There is a need for product display arrangements which are very practical and convenient to install, to reposition and to remove — (for instance, during cleaning of a refrigerated cabinet, as is required by health ordinances). Thus, to optimize the effectiveness and eye-appeal of their product displays, managers of retail food outlets are continually looking for ways of more attractively displaying their products to stimulate purchase, while doing so with arrangements that are flexible and versatile enough to be easily installed and repositioned or removed; i.e., without these operations requiring a great deal of time, labor or skill and without unduly interfering with the flow of customer traffic.

Such a refrigerated cabinet structure is shown in part in FIG. 1 as typical of a prior art installation in a retail food store. Such an installation may comprise a transparent door D offering access by customers to a refrigerated cabinet (not shown) in which one or more shelves, such as mesh shelf Sh, are positioned for "storage-display" of products such as packaged meats, produce, beverages (liquid and frozen), eggs, etc. Such shelves are typically mounted upon standards, such as front and rear standards S, S′, respectively; these typically coupled for rigidity by bracing means such as brace BR. Typically, such a front standard S will be bolted, or otherwise connected, to the door frame (e.g., on a vertical mullion), while the rear standard, such as S′, will be screw-connected (not shown) to a fixture projecting from the ceiling or from the side wall of the cabinet.

Workers would obviously prefer an alternate to spending time and labor to install standards with screw fixtures and the like. Likewise, they would prefer to avoid installing the accompanying mounting fixtures to the cabinet side walls or ceiling, especially since the holes so formed are apt to compromise the refrigerated integrity of the chilled cabinet and in any event require special drilling tools, fixtures and associated time and labor. Such relatively permanent standards are not particularly convenient to remove, although their removal is often required to properly clean-up the cabinet with disposal of spoiled food products from the cabinet floor, side walls and shelves. This is required relatively frequently by health ordinances, as well as the shopkeeper's general desire to maintain a clean, fresh, attractive display. The present invention is directed towards an improved product display arrangement intended to meet the foregoing problems and provide improved features and advantages as described below.

A further objection to prior art cabinet display arrangements such as those indicated in FIG. 1 is that relatively horizontal shelves do not always present the most attractive display or give optimum sales impact for many food products. Also they are not particularly suitable for small "shallow" display cabinets. For instance, in a small delicatessen or "after-hours" market, most of the cabinet's rear section is often used to store inventory with only the front section used for actual product display.

One disadvantage to horizontal shelving is the limited product-view it gives to the customers. The angle through the transparent refrigerated doors is poor and goods are often hidden by intervening shelving structures or by overlying products which tend to get displaced on the flat shelving, one product covering up the second, as customers manipulate them to make a selection. A partial solution is to adopt a "stepped" shelf such as that shown in FIG. 2 where the products are arranged, "theater fashion", on a series of elevated steps to maintain some semblance of segregation and thus keep each little group of products and their associated labels more clearly in the customer's view. The invention disclosed herein is intended to provide a product display arrangement improving on such approaches.

Thus, it is an object of the invention to provide structures to meet the aforementioned and related problems and difficulties. A related object is to do so by providing an improved, portable unitary display structure for mounting food product in a refrigerator cabinet and the like. A further object is to do so in a light, simple unit that is easy and convenient to install and to remove or reposition — versatile enough to fit many different cabinet dimensions and many different positioning plans. Yet another object is to do so with a unit providing for more effective product display, being readily positionable, close to customer access, and at an attitude (e.g., fully-vertical, or tilted) serving to display the product to its best advantage.

Yet another object is to do so using a product-mounting panel board suspended between two or more spring-loaded standards for a frictional spring-biased engagement between upper and lower fixed bases. Yet a further object is to provide such a panel for vertical mounting of product-displaying shelves, clips and the like in various selectable attitudes and locations.

SUMMARY OF THE INVENTION

In accordance with the present invention, an improved product-display carrier arrangement is provided, especially adapted for convenient adjustable positioning, removal and repositioning in refrigerated cabinets and the like, obviating the above-described shortcomings of the prior art. The arrangements described provide portable, unitary display structures made of modular units which are easy and practical to fabricate and which form a unit which is convenient to install and to remove, being versatile enough to fit many cabinet sizes and positioning plans and adaptable for pre-loading with product and fittings, etc., if desired.

Briefly described, a carrier-backing is arranged to be suspended between a pair of length-adjustable mounting standards, each standard including a resilient position-adjustable contact means on one end and, preferably, also including a threaded height-adjusting contact means on the opposite end for leveling of the unit.

The associated features and advantages will occur to those skilled in the art upon consideration of the following detailed description of preferred embodiments indicating how to make and use the same, when read in conjunction with the accompanying drawings, wherein like reference numerals denote like elements:

FIG 1 is a perspective view suggestively indicating a refrigerated "deli cabinet", seen in front elevation and of a type generally recognized in use today;

with FIG. 2 showing a stepped rack apt for use therein;

FIG. 3 is a frontal isometric elevation of an embodiment of the present invention shown as including product-mounting pegs, clips and baskets;

with FIG. 4 comprising a schematized part-sectional showing of one of the two standards in FIG. 3;

Figure 10:
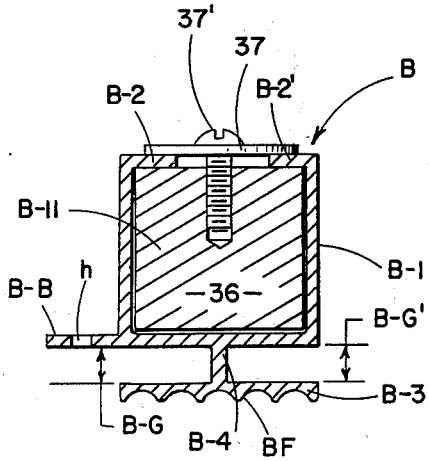
Figure 4:
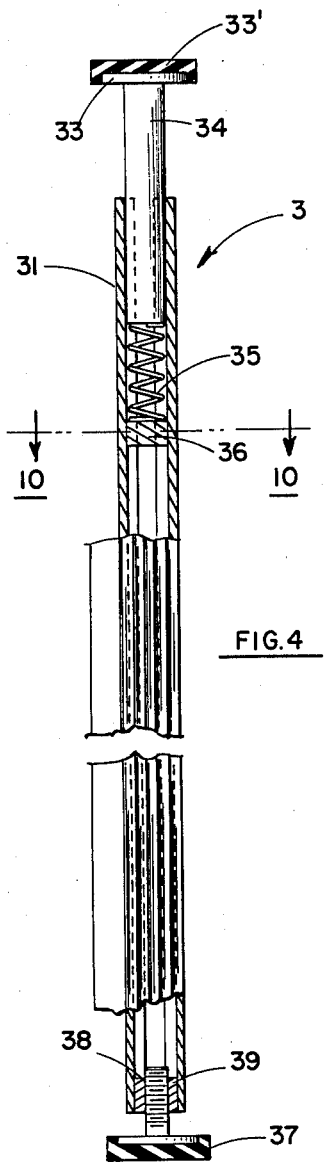
Figure 8:
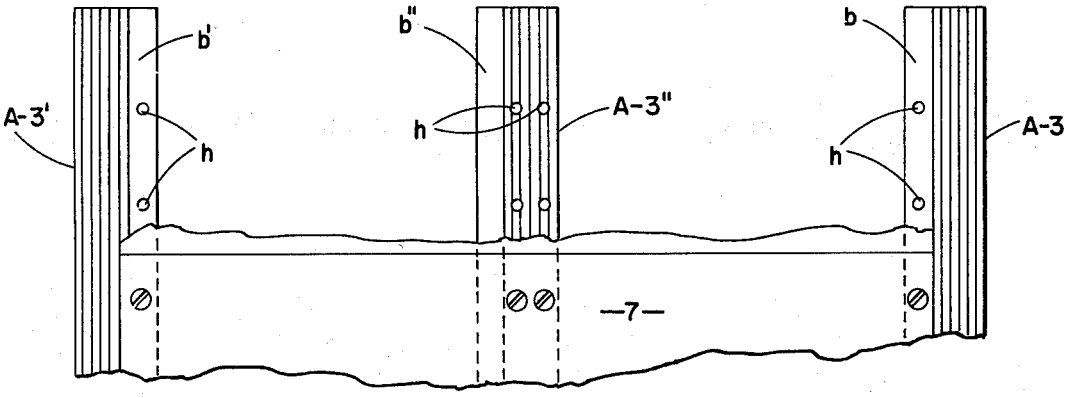
Figure 7:
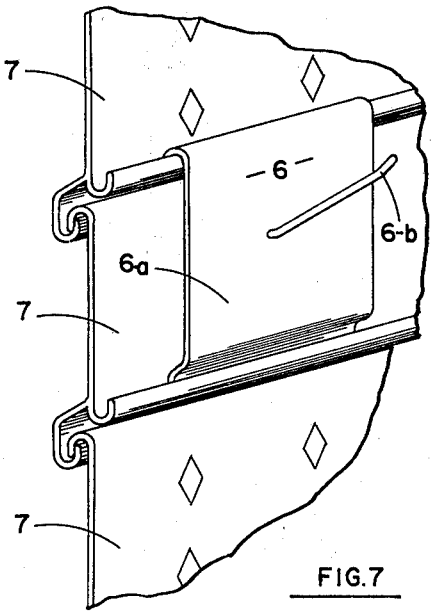
Figure 9:
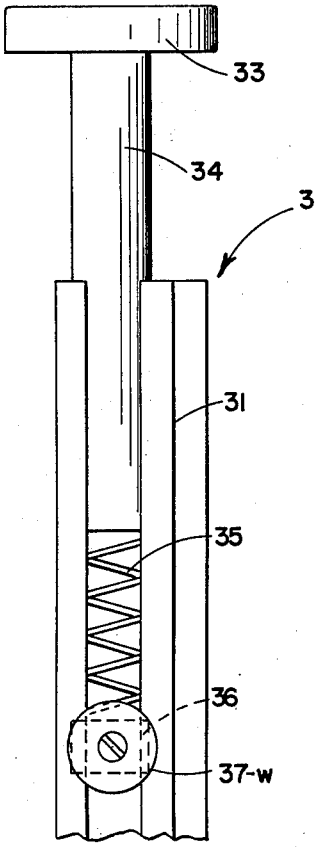

while FIG. 7 shows the same together with a peg hanger clipped thereon;

FIG. 8 is a front elevation of an alternate array of standards;

FIG. 9 shows an enlarged elevation of the upper end of the standards of FIG. 4; and FIG. 10 is a cross-sectional view of a standard constructed in accordance with the present invention.

DETAILS OF SOME PREFERRED EMBODIMENTS

Figure 1:
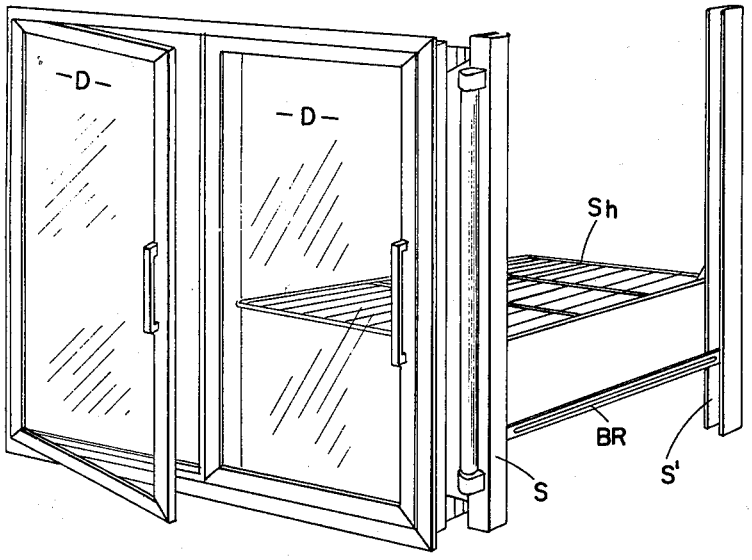
PRIOR ART FIG. 1
Figure 2:
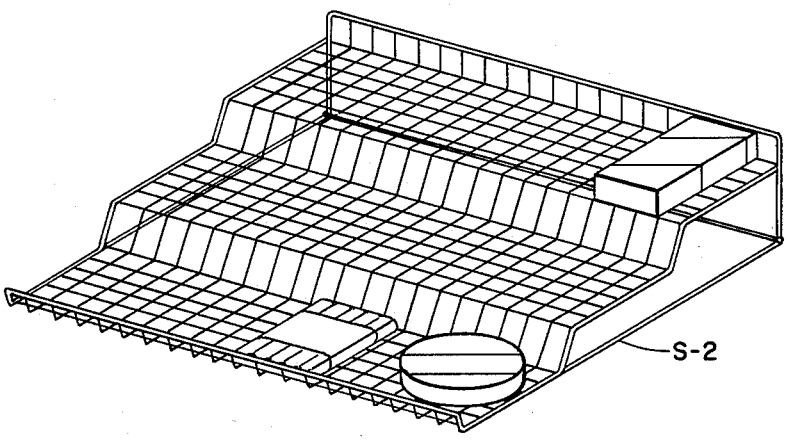
Figure 3:
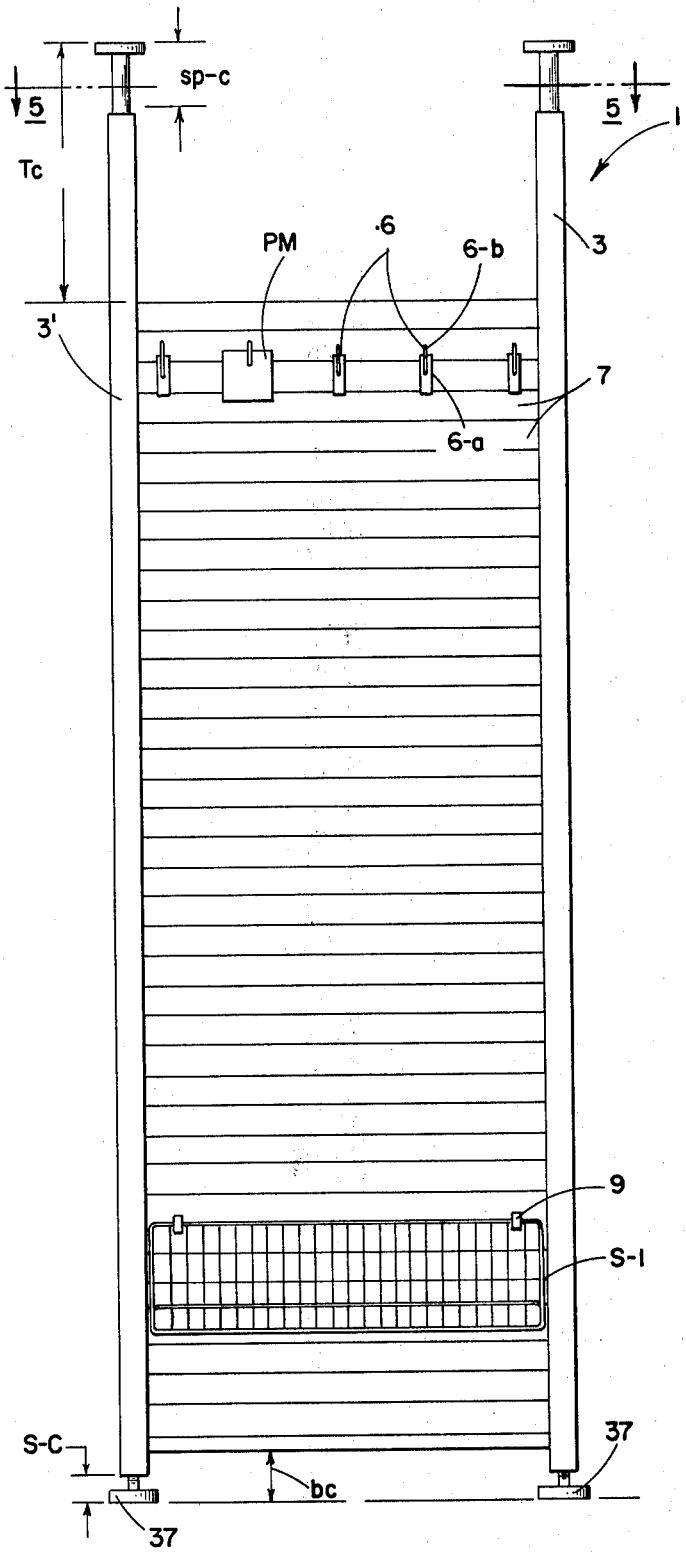
Figure 5:
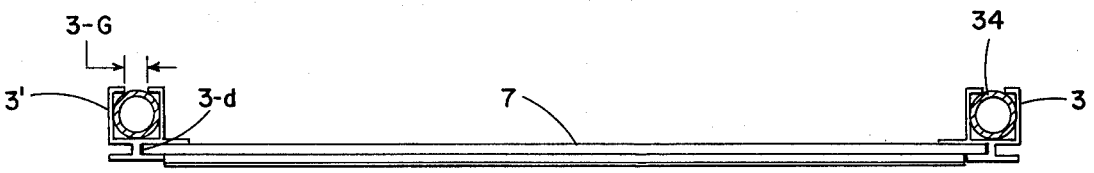
FIG. 5 is a top sectional view of the embodiment of FIG. 3.

Referring now to the drawings and particularly to FIGS. 3, 4 and 5, there is shown an embodiment of a product display arrangement 1 comprising a display panel, or backboard structure 7 mounted and secured between a pair of similar "adjustable-length" standards 3, 3'. The standards 3, 3' are disposed between fixed upper and lower bases — preferably the ceiling and floor of a refrigerated cabinet of the type described above in connection with FIG. 1 — being functionally engaged therewith. This is best shown in FIG. 4, a section through one of the standards, indicating that each standard preferably comprises a tubular member 31 which is relatively hollow at both ends and is provided with a relatively fixed bottom pedestal 37 projected from tube 31 on a threaded shaft 38 adapted to be threadedly coupled to a plug 39 closing the bottom end of tube 31. Pedestal 37 is thus capable of being repositioned relative to the lower end of tube 31 simply by screwing in or out with respect to plug 39 thus adjusting the level of the panel 7 carried by the standard.

At the other, upper end of tube 31 a similar top pedestal 33 is projected on an associated shaft 34 affixed on the upper end of a helical coil spring 35 grounded at a prescribed portion of tube 31 so that, as indicated by the arrow, the height of pedestal 33 may be adjustably positioned by simply urging shaft 34 against the bias of spring 35 to a prescribed degree. It will be apparent that with both standards so constructed, the panel 7 may be suspended therebetween to comprise a single integral unit pre-assembled and carried by one man into a refrigerated cabinet and placed where desired to carry and display goods for sale.

With the bottom pedestals leveled to dispose the bottom of panel 7 a prescribed distance above the floor (adjustable floor clearance bc in FIG. 3 — the adjustability indicated by screw-clearance S-C), the upper pedestal, including resilient frictional rubber member 33', may be depressed to "clear" the ceiling (or other upper fixed structure provided therefor). Unit 1 is then pivoted into the appropriate vertical position and the spring members released so as to frictionally engage the ceiling and fix the unit into position a prescribed distance behind the cabinet door. Top and bottom clearance is provided for good cooling-air circulation i.e., clearance Tc between the top of board 7 and the ceiling of the upper attachment member and bottom clearance bc provide desired passages for refrigerated air flow. The adjustable range positioning of top pedestal 33 against the action of bias springs 35 is indicated by the spring clearance SP-C designated.

Panel 7 may be comprised of any relatively rigid mounting material, attractively finished and preferably provided with engagement means (such as SL-R FIG. 6) for the attachment of hooks, clips and associated baskets, shelving, etc. (e.g., so clip-on pegs 6 and clips 9 for basket shelves may be suspended thereon). Other similar types of basket shelving with associated clips are known in the art. A display peg 6 is shown with a packaged meat product PM depending therefrom in typical fashion as known in the art (FIG. 3). This peg comprises an arm 6-*b* projected from a base 6*a* adapted to intercouple with panel ridges as illustrated in FIG. 7.

Workers in the art will recognize that such a unitary display unit 1, which is readily installed and repositioned manually is made to order for convenient display of large-volume, fast-moving items. Such a unit is adapted for convenient, selective placement anywhere within a refrigerated cabinet. Installation is rapid and inexpensive since the unit may be provided fully-assembled ready for positioning at will and immediate stocking without the necessity for the drilling of holes or attachment of screws. Such a "stand-up" display board also offers merchandising flexibility since it is adapted to mount many different kinds of pegs, clips and other attachment means for mounting products in various selectable positions, such as retaining clips 9 for suspending baskets of fruit, produce and the like, or for mounting shallow flat shelves for eggs, as known in the art.

Unlike many prior art installations the vertical display board of the present invention is particularly effective for merchandising packaged meats and the like in close proximity to the customer as he passes the glass door to the cabinet. Indeed, the visual impact on the customer of the label and product appearance (particularly as packaged in transparent wrap) is a marked inducement to sales. The subject invention facilitates such point-of-sale display arrangements in a vertical display format that is simple, yet versatile enough to readily allow quick adjustment of the position and attitude of the display panel. Further, its spring-mounting and provision for rapid installation and repositioning makes such a display arrangement economical and convenient.

The subject display is relatively easy to ship and to assemble "on-site". The display is eminently simple to install. Time-consuming preparations such as required with systems utilizing screw fixtures and tapping of screw holes into walls or framework structures are avoided.

Typically, to install a display panel in accordance with the present invention, a workman need only establish and mark its position (distance behind cabinet's glass door, this depending somewhat upon shelf-depth, etc.). The installer will normally mark panel lines on the floor and ceiling to thereby represent the "plane of display" to be occupied by the panel he is about to install. He may then position the novel pre-assembled display unit without further preparation.

That is, the unit may comprise a pre-assembled, integral display which may be prefitted with hooks, pegs, clips, baskets and shelves, ets., and product mounted thereon where convenient (without providing an unwieldy, burdensome load for one or two men to transport). The installer may then set-up the panel along the indicated "plane", simply by locating its bottom pedestal at the appropriate floor position, then doing likewise for the top pedestal, first depressing their telescoped mounting legs inward against the positioning-spring until the panel is tipped upright to the proper attitude, then releasing them. The installer may readily and easily level the bottom edge of the panel by adjusting the leg-leveling arrangement 38, 39 provided on the bottom pedestals 37, to establish an appropriate spacing above the floor. The pedestals are frictionally engaged (against the cabinet ceiling, etc.) via a resilient pad spring-urged outward, as known in the art.

The arrangement 37, 38, 39 functions as a leveler means while the upper pedestal pad 35 (affixed atop upper pedestal 33, and preferably of rubber or other resilient, frictional-engaging material) provides a resilient friction-coupling to the ceiling (or like fixed upper base).

Figure 6:
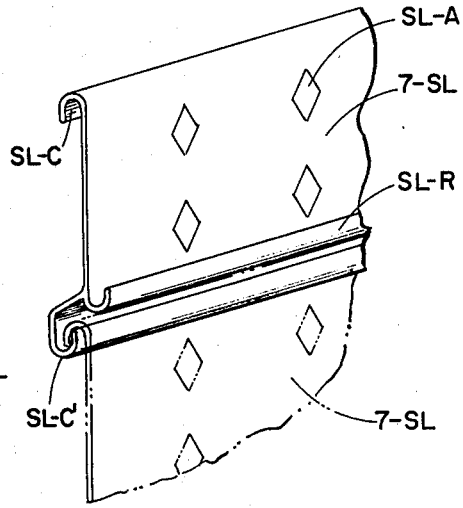
FIG. 6 is a fragmentary, enlarged, isometric front (and side) elevation of a pair of interfitting modular panel-strips of the FIG. 3 embodiment.

In the preferred structure, panel 7 is comprised of metal strips (e.g., ¼ inch steel "roll forms", 6 inches wide), painted attractively, interfitting together as in FIG. 6 and providing product-suspension means. That is, as indicated more particularly in FIG. 6, strips 7-SL are preferably modular and similar to interfit vertically, forming a single integral display panel fo selectable height — these modules being installable in the field such as at the merchandising site if desired. Preferably, however they are installed at the factory and riveted onto the standards 3, 3' as known in the art, or otherwise connected thereto.

Standards 3, 3' as seen in the exemplary cross-section view of FIG. 10 are preferably comprised of a single metal (aluminum) extrusion module, being provided with a groove B-G accommodating the (one-fourth inch thick) backboard panel, being cut sufficiently deep (here about three-fourth) to assure positive locking engagement of the board 7 between the standards. Each of these roll forms (or slats) 7-SL is preferably formed with interlocking upper and lower catch means SL-C, SL-C', or the like provided with a rim SL-R extending across the slat to form a ledge or grip for the attachment of pegs 6, clips 9 or other means of mounting products on the board 7 as known in the art. Also slats 7-SL are preferably perforated, as at SL-A, to facilitate a uniform flow of refrigerated air through the board to maintain maximum uniform cooling efficiency in the cabinet as known in the art.

According to one feature hereof, each standard 3, 3', etc. preferably comprises an aluminum extrusion (FIG. 10) comprised of a main elongated, tubular body B-1, which is relatively rectangular in cross-section. Projected from B-1 are a flange strip B-B and a facing strip B-F projected out along the length of B-1. Flange B-B is adapted to afford a substrate to engage the backing and guide it into gap B-G, providing a posterior base for attachment of threaded connectors (e.g., see flanges *b,b'* of schematic standards A-3, A-3' in the alternate "3-standard" array of FIG. 8, with screw holes *h*). Facing B-F is adjusted to cover (ie, "hide") body B-1, etc., in normal use (e.g., as used on opposed end-standards carrying the backing therebetween, as for 3, 3' in FIGS. 3 and 5). B-F is provided with an aesthetically attractive front coating of selected character (e.g, the anodized fluted surface indicated in FIG. 10). Facing B-F can also serve to mount the backing, such as when used as an intermediate, screw-connected support, as at A-3'' in FIG. 8 (where screw holes h are tapped into the facing, avoiding strut B-4, of course — this being conveniently accommodated by providing a second gap B-G' on the side of strut B-4 opposite gap B-G).

The hollow body of tube B-1 is preferably left with an elongate gap 3-g (see FIG. 5) defined by a pair of flanges B-2, B-2', (FIG. 10) and extending along its (rear) length. Gap **3-*g* affords access to inner parts such as the leveling means 38, 39 and the means for adjustably positioning helical coil spring 35 (to adjust the force on the upper standard contact). Preferably, this spring-adjust means comprises a plug 36 substantially fitting the cross-sectional interior of tube B-1 (FIG. 10), to be retained and slidingly guided thereby, and an associated adjustable fastening clamp. The clamp is preferably comprised of a washer 37 "tightening" coupled to plug 36 on a screw and adapted to be tightened into it — thus squeezing the plug and washer onto flanges B-2, B-2'** and frictionally locking them at a selected location thereby (as known in the art). Of course, other like positioning means may be used to locate the compression-base for this spring, as known in the art.

It will be quite apparent that such installation need take only a few minutes as compared with the use of time-consuming, threaded connector installations in the prior art. Moreover, if the initial installation is not exactly as desired or if conditions require that the attitude and/or position of the display panel be shifted, this may readily be attended to by one of two unskilled workers in just a few seconds. Repositioning may be accomplished without even bothering to unload product from the board. No tools or special skills are required, not are the adjacent walls or framing defaced or cluttered-up with fixtures, screw-tappings, etc. Of course, when the time comes to remove this display panel (e.g., for cleaning the cabinet), it is a simple matter for a worker to do so in a few seconds — leaving the products and their storage carriers in place on the panel, to be carried our to the point of redistribution, if desired. As an added advantage, this "panel-portability" feature enables one to restock with product rather quickly and conveniently by carrying the panel to the storage stockpile — rather than the reverse as conventional display structures now require (i.e., conventionally stock must be carried separately into the sales area to be arranged on the display).

Thus, it will be apparent to those skilled in the art that the foregoing describes practical working preferred embodiments of the invention, both as to their construction and use and, particularly, for providing a simple verstaile display panel arrangement for displaying food products in refrigerated cabinets so as to provide portability and versatile positioning and re-positioning capability. Of course, it will be understood that the present invention is intended to embrace not only the structures, materials, methods and arrangements aforesaid, but also all reasonable equivalents thereof as understood by those skilled in the art, limited only by the appended claims.

What is claimed is:

1. An adjustably positionable display carrier for refrigerated food cabinets, comprising:

a relatively planar backing including attaching means for selectable positioning of product retaining means thereon; and at least two elongate length adjustable mounting standards, each standard being coupled to said backing means so as to support said backing means relatively vertically between fixed upper and lower bases in such a cabinet, each standard including an elongate body section and position adjustable contact means projected from at least one end thereof for fixedly engaging the cabinet; said contact means being adapted to be manually adjustable in position relative to the body section.

2. The display carrier as recited in claim 1 wherein each said contact means includes a contact pad mounted at the outer end of an elongate shaft telescopically projected from one end of said body section and coupled thereto to be spring-based against inward-telescoping thereof toward the center of said body section.

3. The combination as recited in claim 2 wherein said shaft is adapted to fit telescopingly within the confines of a respective hollow end of said body section;

said body section also including limiting stop means mounted adjacent said hollow end for limiting the inward retraction of sid telescoping shaft together with spring bias means mounted between said shaft and said stop means to resiliently bias said shaft toward tis extreme outward position.

4. The carrier as recited in claim 3 wherein each said limiting stop means comprises a plug fitting into respective hollow end of said body, said plug being fixedly coupled to said body at a selectable position along the body length.

5. The combination as recited in claim 4 wherein each standard includes said resilient contact means at one end and a position-adjustable screwable contact means at its opposite end, said screwable means being threadably coupled to the respective end of said body section so as to be manually screwed thereinto and thereby reposition the backing means with respect to the cabinet base.

6. The combination as recited in claim 5 wherein both said contact means include resilient frictional pads on their outer, cabinet-engaging ends.

7. The combination as recited in claim 1 wherein said backing means comprises a panel built up by a selectable number of panel strips engaged between accommodating engagement portions of a pair of said standards, said strips each including a product-retaining portion and being stacked between said standards to define a panel board of prescribed selectable height.

8. The combination as recited in claim 7 wherein said strips comprise identical modular strips, each including a suspension rim extending substantially across its length and adapted for mounting product retention means and also including male and female interconnection means along the respective upper and lower edges thereof, to accommodate selective interconnection of a prescribed number of said strips forming said height-adjustable panel board.

9. The combination as recited in claim 8 wherein said strips comprise metal sections perforated in a prescribed manner to allow circulation of air coolant.

10. A portable product display arrangement for storing and displaying food items in a refrigerated cabinet, the arrangement comprising in combination:

a substantially planar item display backboard means mounted between at least two adjustable-length standards adapted for mounting in the cabinet without use of threaded connectors, each standard comprising an elongate frame together with biased contact means projected from at least one end thereof, each contact means comprising a frictional engagement member telescopically projected from said frame on a resilient, return-biased coupling.

11. The combination as recited in claim 10 wheren said frame includes an elongate crevice of constant gap-width extending along one side and adapted to fixedly accommodate said backboard means between two opposed standards.

12. The combination as recited in claim 10 wherein said frame includes at least one elongate, laterally projecting flange means extending along its length and adapted to be attached to said backboard means by selectably positioned fastener means therefor.

13. The combination as recited in claim 10 wherein said frame comprises an elongate frame body including a laterally projecting flange portion with an associated crevice gap on at least one side thereof, and also includes a faceplate extending along at least one of the two sides orthogonal to that of the flange; said faceplate being sufficiently wide to substantially hide said body from frontal view and projected outward therefrom to form said crevice gap.

14. The combination as recited in claim 13 wherein each said faceplate is projected out from said frame body by said gap-width on an elongate strut.

15. The combination as recited in claim 14 wherein each said faceplate is provided with an attractive decorative finish on its outer, visible surface.

16. The combination as recited in claim 15 wherein said frame body comprises a hollow tube, with an telescopingly-inserted extension arm interfitted at one end and coupled to the body by a helical-coil compression spring, grounded on a prescribed selectably-positionable limiting-slug.

17. The combination as recited in claim 16 wherein leg-leveling means are threadably coupled to the end of said frame body opposite said resiliently-biased engagement member.

18. The combination as recited in claim 17 wherein the rear side of said body, opposite said faceplate, is relieved along the length of one side to form an access gap for accommodating insertion, adjustment and selectable positioning of said leg-leveling and resilient contact means at opposite ends thereof.

19. The combination as recited in claim 16 wherein one of said standards is disposed on either side of said backing means with said strips engaged in the respective crevice of each, and wherein at least one other similarly configured standard is disposed intermediate said two opposed standards with its faceplate coupled to respective strip portions by connector means therethrough.

* * * * *